United States Patent [19]

Ubukata et al.

[11] Patent Number: 4,843,363

[45] Date of Patent: Jun. 27, 1989

[54] THREE-PHASE THERMAL PROTECTOR

[75] Inventors: Susumu Ubukata, 549-banchi, Nakasuna-cho, Tempaku-ku, Aichi-ken; Yasukazu Mizutani; Syozo Iyoda, both of Nagoya-shi, all of Japan

[73] Assignee: Susumu Ubukata, Nagoya, Japan

[21] Appl. No.: 250,087

[22] Filed: Sep. 28, 1988

[30] Foreign Application Priority Data

Oct. 7, 1987 [JP] Japan ..... 62-253401

[51] Int. Cl.[4] ..... H01H 61/08; H01H 37/12; H01H 37/54

[52] U.S. Cl. ..... 337/94; 337/347; 337/368

[58] Field of Search ..... 337/94, 57, 347, 349, 337/360, 368

[56] References Cited

FOREIGN PATENT DOCUMENTS 31-5747 4/1956 Japan .
46-34532 10/1971 Japan .
57-34623 2/1982 Japan .

*Primary Examiner*—H. Broome

*Attorney, Agent, or Firm*—Foley & Lardner, Schwartz, Jeffery, Schwaab, Mack Blementhal & Evans

[57] ABSTRACT

This invention relates to a three-phase thermal protector having two pairs of fixed and movable contacts for opening and closing the neutral of wye-connected phase windings of a three-phase induction motor. The protector further includes a header plate having two terminal pins secured by an insulating sealant material respectively, a support plate secured to the header plate, an elastic member disposed so as to be approximately parallel to the support plate, the elastic member having two ends, one of which is secured to the support plate, a thermally responsive element secured at one end thereof to the other end of the elastic member, the thermally responsive element carrying the movable contacts and moving and returning with snap action in response to temperature change, a pivot mounted on a stationary member either at the header plate side or at the support plate side so that the surface of connecting portions of the thermally responsive element and the elastic member is engaged therewith, and an operative temperature calibrating mechanism provided on the support plate for exerting a contact pressure between the movable and fixed contacts.

3 Claims, 3 Drawing Sheets

THREE-PHASE THERMAL PROTECTOR

BACKGROUND OF THE INVENTION

1. Field of the Invention

The present invention relates generally to a three-phase thermal protector having two pairs of contacts, a single thermally responsive element for opening and closing the two pairs of contacts, and an operative temperature calibrating mechanism for calibrating an operative temperature of the thermally responsive element, and more particularly to such a three-phase thermal protector suitable for opening and closing the neutral of wye-connected phase windings of a three-phase induction motor.

2. Description of the Prior Art

Conventional three-phase thermal protectors of the above-described type are disclosed by Japanese Published Utility Model Application No. 31-5747 entitled "DISH-SHAPED BIMETAL RELAY WITH THREE PAIRS OF CONTACTS" or Japanese Published Patent Application No. 46-34532 entitled "THERMOSTAT SWITCH." Six contacts, that is, three movable contacts and three fixed contacts are employed in the above-mentioned protectors. Such a number of contacts entails an economic problem that the manufacturing cost of the protector is increased.

The inventors have disclosed, in Japanese Laid-open Patent Application No. 57-34623, a thermal protector for three-phase induction motors, in which the number of the contacts is reduced to four, that is, two movable contacts and two fixed contacts. However, this thermal protector is the type that an operative temperature of a snap-acting thermally responsive element comprising bimetallic or trimetallic plates is calibrated by deforming a hermetically sealed housing of the protector. Accordingly, the calibration of the operative temperature of the thermally responsive element relies upon a method of adjusting the contact pressure between the contacts to a predetermined value at the room temperature after the enclosing of a movable mechanism in the housing. This method of calibrating the operative temperature results in a disadvantage that when the difference of operation time periods between the two pairs of contacts exceeds the tolerance owing to the difference of contact gaps between the respective pair of contacts, an effective measure cannot be taken to visually check or correct the difference of the operation time periods between the respective pairs of contacts.

SUMMARY OF THE INVENTION

Therefore, a first object of the present invention is to provide a three-phase thermal protector which employs two pairs of contacts to open and close the neutral of wye-connected phase windings of a three-phase induction motor and which is, therefore, advantageous from an economical standpoint.

A second object of the present invention is to provide a three-phase thermal protector wherein at the manufacturing step before enclosing a contacts opening and closing mechanism in a hermetically sealed housing, a work for calibrating the operative temperature of the thermally responsive element can be visually performed and which is, therefore, advantageous in calibrating the operative temperature of the contacts.

The three-phase thermal protector in accordance with a first aspect of the invention comprises a metallic header plate having two apertures formed therein, two terminal pins secured in the apertures of the header plate by an insulating sealant material applied therebetween, respectively, a support plate secured to the header plate, two fixed contacts directly secured to one ends of the terminal pins so as to be opposite to the support plate on a plane respectively, and an elastic member provided so as to be approximately parallel to the support plate. The elastic member has two ends, one of which ends is secured to the support plate. The thermal protector further comprises a thermally responsive element secured at one end thereof to the other end of the elastic member. The thermally responsive element is provided with an approximately central shallow dish-shaped portion so as to move and return with snap action in response to temperature change. Two movable contacts are secured to portions of the thermally responsive element respectively, which portions correspond to two tops forming a triangle together with the other top on the thermally responsive element on which top the elastic plate is secured. A pivot is mounted on a stationary member either at the header plate side or at the support plate side so that the surface of connecting portions of the thermally responsive element and the elastic plate is engaged therewith. An operative temperature calibrating mechanism is provided on the support plate for pushing the dish-shaped portion of the thermally responsive element, thereby exerting an approximately uniform contact pressure between the two movable contacts and the two fixed contacts and between the connecting portions and the pivot, respectively. The operative temperature calibrating mechanism includes a means for controlling the pressure against the dish-shaped portion of the thermally responsive element.

The three-phase thermal protector in accordance with a second aspect of the invention comprises a metallic header plate having two apertures formed therein, two terminal pins secured in the apertures of the header plate by an insulating sealant material applied therebetween, respectively, a support plate secured to the header plate and parallel to the header plate, and two contact support arms mounted on the header plate with a ceramic member interposed therebetween and having one ends secured to the respective terminal pins and the other ends to which two fixed contacts are secured. The fixed contacts are opposite to the support plate on a plane. An elastic member is provided so as to be approximately parallel to the support plate. The elastic member has two ends, one of which is secured to the side of the support plate corresponding to the fixed contacts. A thermally responsive element is secured at one end thereof to the other end of the elastic member. The thermally responsive element has an approximately central shallow dish-shaped portion so as to move and return with snap action in response to temperature change. Two movable contacts are secured to portions of the thermally responsive element, respectively, which portions correspond to two tops forming a triangle together with the other top on the thermally responsive member on which the elastic member is secured. A pivot is formed integrally with the ceramic member so that the surface of connecting portions of the thermally responsive element and the elastic plate is engaged therewith. An operative temperature calibrating mechanism is provided on the support plate for pushing the dish-shaped portion of the thermally responsive element, thereby exerting an approximately uniform contact pressure between the two movable contacts and the two fixed contacts and between the connecting portions and the pivot. The operative temperature calibrating mechanism includes a means for controlling the pressure against the dish-shaped portion of the thermally responsive element.

The above-described thermal protector in accordance with the present invention is to be enclosed in a housing at the last manufacturing step to be hermetically sealed. At a step before enclosing the protector in the housing, a protector in the housing, the operative temperature calibrating mechansim mounted on the support plate may be operated to thereby visually execute the calibration of the operative temperature of the thermally responsive element.

Other and further objects of the present invention will be become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
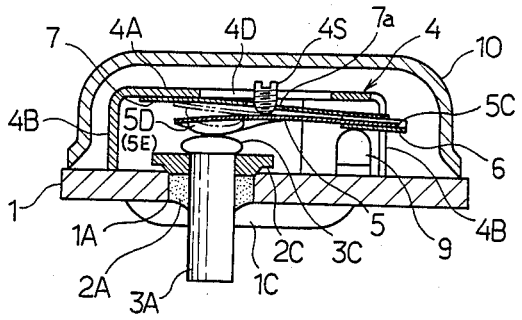
FIG. 1 is a longitudinal cross section of the threephase thermal protector in accordance with a first embodiment of the present invention.
Figure 2:
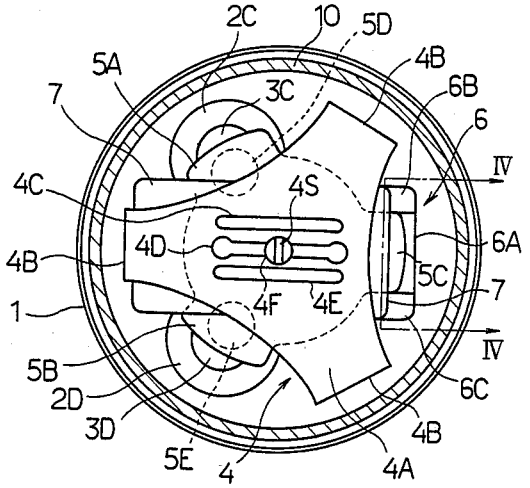
FIG. 2 is a plan view of the protector with a housing eliminated.
Figure 3:
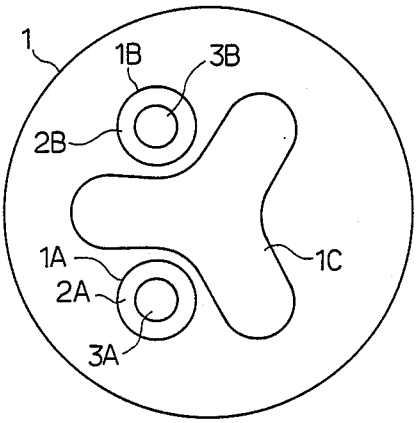
FIG. 3 is a bottom plan view of the protector.
Figure 4:
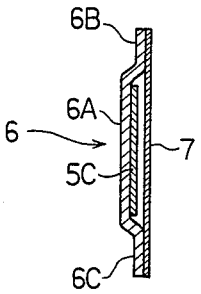
FIG. 4 is an enlarged sectional view along line IV—IV in FIG. 2.

Referring now to FIGS. 1–4 illustrating the threephase thermal protector of a first embodiment, a base or header plate 1 is formed by blanking a relatively thick steel to a circular configuration. The header plate 1 has two apertures 1A and 1B in which two electrically conductive terminal pins 3A and 3B are hermetically secured by sealing materials 2A and 2B such as glass, respectively. Ceramic rings 2C and 2D are attached to the respective terminal pins 3A and 3B so that the glass sealing materials 2A and 2B are protected against arc and subsequently, fixed contacts 3C and 3D formed from silver alloy are secured to the upper edges of the terminal pins 3A and 3B by way of welding or the like, respectively, as shown in FIG. 1. A plate-shaped support 4 is secured to the header plate 1 with the lower end of three leg-like portions 4B secured to the support 4 by way of spot welding or the like. An elastic member 7 formed of a resilient metallic plate is secured, at the left-hand end, to the side of the support 4 facing the base plate 1 by way of welding or the like, as seen in FIG. 1. The righthand end of the elastic member 7 is secured, through a connection strip 6, to the right-hand end of a bimetallic or trimetallic thermally responsive element 5 which deforms its configuration in response to temperature change, as seen in FIG. 1. The thermally responsive element 5 shown by both full line and dotted line has a central substantially circular portion and three projected portions 5A, 5B, and 5C projected in directions different from one another. Movable contacts 5D and 5E are secured to the projected portions 5A and 5B respectively, as shown in FIG. 2. The connection strip 6 is formed of a relatively thick steel and has a central concave portion 6A, as shown in FIG. 4. A projected portion 5C of the thermally responsive element 5 is secured to the inner bottom surface of the concave portion 6A by way of welding or the like. The right-hand end of the elastic member 7 is welded to both ends 6B and 6C of the connection strip 6, which ends have a larger height than the concave portion 6A. The connection strip 6 may be eliminated, if desired. Elimination of the connection strip 6 is effective where after the projected portion 5C of the thermally responsive element 5 is directly welded to the elastic member 7, the thermally responsive characteristics of the element 5 is not affected by heat induced during the welding or where a heat treatment can be made for elimination of the heat affection.

Three elongated slits 4C, 4D, and 4E are formed in the support 4. The central slit 4D has a central circular portion 4F for receiving a screw 4S. Since the diameter of the circular portion 4F is smaller than the external diameter of the screw 4S, a thread groove is formed in the inner surface of the circular portion 4F when the screw 4S is forced into the circular portion 4F with rotational movement. The screw 4S is always tightened up by the thread groove. It is to be readily understood that the screw 4S preferably has a higher hardness than the circular portion 4F. A suitable selection of the length of each slit, space between the central slit and the adjucent slits, thickness of the material of the support 4 provides a threadly engaging structure having no idle space and requiring a proper rotational torque. The lower distal end of the screw 4S is brought into contact with an approximately central portion of the dish-shaped portion of the thermally responsive element 5 through an opening **7*a* formed in the elastic member 7, as shown in FIG. 1. Since the diameter of the opening 7*a* formed in the elastic member 7 is larger than the external diameter of the screw 4S, it does not come into contact with the inner surface of the opening 7*a*. A pivot 9 having an upper rounded edge is formed by securing a suitable metal or ceramics to the header plate 1. The pivot 9 is brought into contact with the lower surface of the connection strip 6. For example, when the thermally responsive element 5 is depressed at the normal temperature by screwing the screw 4S in the circular portion 4F, the depressing force is dispersed to the movable contacts 5D, 5E and the lower surface of the connection strip 6, thereby applying pressure to the fixed contacts 3C, 3D and the pivot 9. Consequently, the strength of stress acting on the dish-shaped portion of the thermally responsive element 5 is varied by screwing the screw 4S, whereby the operative temperature of the thermally responsive element 5 can be adjusted in the range between a contacts-opening temperature at which the dish-shaped portion of the thermally responsive element 5 changes its curvature with snap action and the contacts-closing temperature at which the dish-shaped portion of the thermally responsive element 5** re-changes its curvature to return to the former state. This work is generally referred to as the calibration of the operative temperature of the thermal protector.

The thermally responsive element 5 has an upwardly concave configuration at the normal temperature as shown by full line in FIG. 1. The calibration is performed such that when an ambient temperature is increased to a predetermined value, for example, 150° C., with a suitable value of pressure applied between the contacts, the thermally responsive element 5 changes the direction of its curvature with snap action as is shown by dotted line in FIG. 1. More specifically, a force exerted by the elastic plate 7 on the connecting portions of the elastic plate 7 and the thermally responsive element 5, namely, on the connection strip 6 causes the connection strip 6 to be pushed against the upper surface of the pivot 9, whereby a biasing force is exerted on the connection strip 6 so that it is slightly inclined in the clockwise direction about the connection point, as seen in FIG. 1. Accordingly, the movable contacts 5D, 5E are departed from the fixed contacts 3C, 3D, respectively. When the temperature of the thermally responsive element 5 is decreased to a value smaller than a predetermined one, for example, 80° C., the thermally responsive element 5 moves with snap action to thereby recover its former state presenting the upwardly concave curvature as shown by full line in FIG. 1. In this embodiment, a housing 10 formed of steel by means of drawing is hermetically secured to the header plate 1 by way of ring projection welding. As described above, prior to the securing of the housing 10, the operative temperature of the thermally responsive element can be calibrated and the snap-acting movement and return movement of the dish-shaped portion of the thermally responsive element can be checked. A rib 1C mounted on the base plate 1 is utilized to enhance rigidity of the hermetically sealed thermal switch against the external pressure in the case where the housing 10 is secured to the header plate 10.

In the thermal protector described above, the terminal pins 3A, 3B and the header plate 1 are connected to the neutral of three wye-connected windings of a three-phase induction motor. Although unbalanced current type motors are exceptionally manufactured, each phase current is usually balanced in the three-phase induction motor. When the thermal protector is to be connected to the windings of the three-phase induction motor, electrical currents flowing between the terminal pins 3A, 3B, between the terminal pin 3A and the header plate 1, and between the terminal pin 3B and the header plate 1 should preferably cause the temperature of the thermally responsive element 5 to be approximately uniformly increased. Accordingly, in the designing of the thermal protector 5, electrical resistance values of parts composing respective electrical paths and degree of affection of heat against the thermally responsive element need to be taken into consideration. More specifically, three electrcial paths are formed: an electrical path from the header plate 1 to the thermally responsive element 5 with the elastic plate 7 serially inserted thereto, an electrical path from the screw 4S to the thermally responsive element 5, and an electrical path from the pivot 9 to the thermally responsive element 5 through the connection strip 6. A contact resistance is exerted between the lower end surface of the screw 4S and the thermally responsive element 5. Additionally, in the case where the pivot 6 is formed of an electrically conductive such as steel, another contact resistance is exerted between the pivot 9 and the connection strip 6. These contact resistances may be eliminated when the pivot 9 is formed from ceramics or when a strip formed from ceramics or the like is attached to the lower end surface of the screw 4S. Practically, however, in the case where the thermal protector is applied to a motor having a large current carrying capacity, the header plate 1, support 4, elastic member 7, connection strip 6, thermally responsive element 5 forming an electrical path from the header plate 1 to the projected portion 5C of the thermally responsive element 5 can be welded. Therefore, the resistance value of the path may be rendered lowest and stable. Accordingly, in the motor having a large current carrying capacity, the heating degree of the thermally responsive element 5 owing to heat induced by the current flowing through the path from the header plate 1 to the projected portion 5C should be equalized to the degree of heat affection against the thermally responsive element owing to the current flowing through the path formed by the thermally responsive element 5 to the terminal pins through the movable and fixed contacts. In the case of a motor having a small current capacity, the pivot 9 should be formed of an insulating material, as described above, or when the pivot 9 is a conductor, an insulation layer should be interposed between the connection strip 6 and pivot 9. Additionally, another insulation layer should be provided on the lower end surface of the screw 4S. Since the terminal pins are made from a material having an extremely high natural resistance value such as nickel-iron alloy so that the expansion coefficiency of the terminal pin material is matched with that of glass as sealing material, heat induced owing to resistance at this portion is transferred to the thermally responsive element through the fixed and movable contacts or by convection or radiation, thereby thermally affecting the thermally responsive element. Therefore, in the case of the motor having a large current carrying capacity, the degree of heat affection of each phase current need to be equalized by employing a suitable clad member in which a metal bar formed of copper or the like is hermetically embedded in in the center of each terminal pin. In the case of the three phase motor of the unbalanced phase current type, a suitable value of electrical resistance of the members through which each phase current flows needs to be selected.

Figure 5:
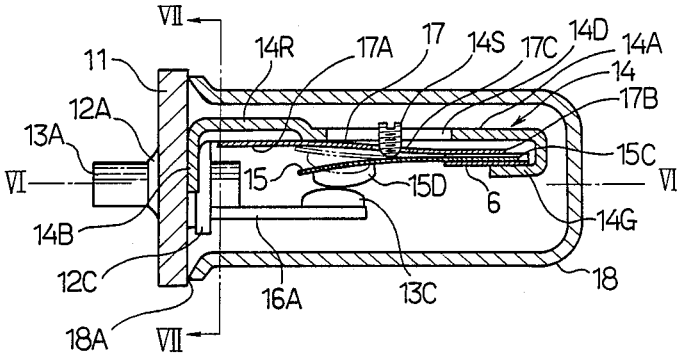
FIG. 5 is a longitudinal cross section of the threephase thermal protector in accordance with a second embodiment of the invention.
Figure 6:
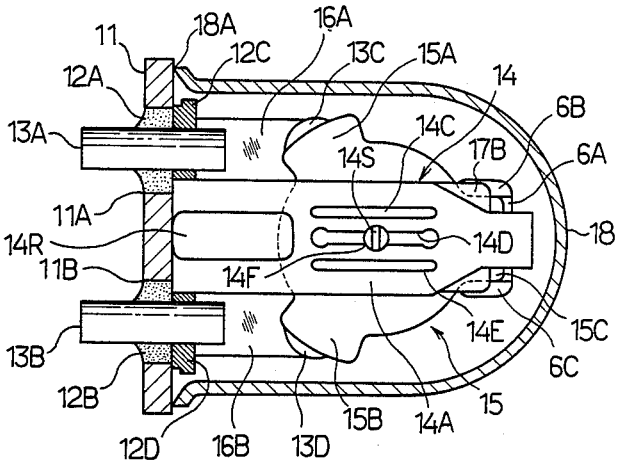
FIG. 6 is a transverse cross section of the threephase thermal protector along line VI—VI in FIG. 5 with the header plate and housing broken.
Figure 7:
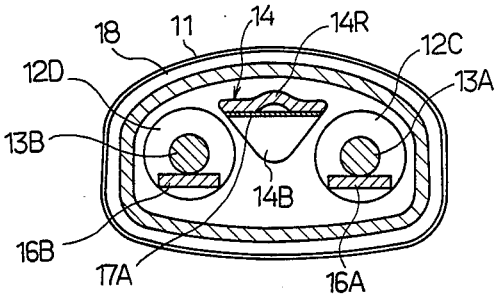
FIG. 7 is a longitudinal section of the protector along line VII—VII in FIG. 5.

Referring now to FIGS. 5–7 illustrating the thermal protector in accordance with a second embodiment, a base or header plate 11 is formed by blanking a relatively thick steel to an approximately oval configuration. The header plate 11 has two apertures 11A and 11B in which two electrically conductive terminal pins 13A and 13B are hermetically secured by sealing materials 12A and 12B such as glass, respectively. A support 14 is rigidly secured at the secured portion 14B to the header plate 11 by way of spot welding, as shown in FIG. 7. A rib 14R is formed in the vicinity of the secured portion 14B of the support 14 by way of drawing so that the rigidity of the support 14 is enhanced. As in the foregoing embodiment, a thermally responsive element 15 formed of a bimetal or the like and including a shallow dish-shaped portion has a generally flat configuration as a whole and three projected portions 15A, 15B, 15C. Two movable contacts 15D, 15E are secured to the projected portions 15A, 15B respectively. A connection strip 6 is fixed on the projected portion 15C. The connection strip 6 has the same configuration as shown in FIG. 4 and the projected portion 15C of the thermally responsive element 15 is welded to the concave portion 6A of the connection strip 6. The right-hand end 17B of an elastic member 17 comprised of a metallic plate having elasticity is secured to both ends 6B, 6C of the connection strip 6. The other end 17A of the elastic member 17 is secured to the support 14 in the vicinity of the portion of the support 14 secured to the header plate 11. Contact support arms 16A, 16B carrying respective fixed contacts 13C, 13D are secured to the terminal pins 13A, 13B respectively after rings 12C, 12D formed from an insulating material having large heat resistance such as ceramics are inserted through the terminal pins 13A, 13B respectively. Three elongated slits 14C, 14D, 14E are formed in the major surface 14A of the support 14 so that the positions of the slits correspond to an approximately central portion of the thermally responsive element 15. As in the foregoing embodiment, the central slit 14D has a circular portion 14F into which a screw 14S is screwed. The diameter of the circular portion 14F receiving the screw 14S is smaller than the external diameter of the screw 14S. Accordingly, the screw 14S is tightened up by a suitable force so that the screw 14S is not loosened. Since the elastic member 17 has an opening 17C having the diameter large enough to insert the screw 14S therethrough without contacting the elastic member 17, the screw 14S depresses the convex side of the dish-shaped portion of the thermally responsive element 15 at room temperature. The distal end portion 14G, that is, the right-hand end of the support 14 in bent, and the projected portion 15C of the thermally responsive element 15 and the right-hand end 17B of the elastic member 17 are secured to the upper side of the lower bent portion 14G which acts as a pivot point, as shown in FIG. 5.

The movable contacts 15D, 15E (contact 15E not shown) are normally engaged with the fixed contacts 13C, 13D (contact 13D not shown) at room temperature, respectively. The elastic member 17 always depresses the projected portion 15C of the thermally responsive element 15 against the pivot point 14G. When the screw 14S is screwed so that the movable contacts 15D, 15E exert a suitable contact pressure agianst the fixed contacts 13C, 13D at room temperature, respectively, the thermally responsive element 15 moves with snap action as shown by dotted line in FIG. 5 when the ambient temperature is increased to a predetermined value, for example, the value of 150° C., thereby separating the movable contacts 15D, 15E from the respective fixed contacts 13C, 13D. Thus, the operative temperature of the thermally responsive element 15 may be calibrated to obtain a suitable value of operative temperature in the range between the contacts-opening temperature at which the thermally responsive element 15 moves with snap action and the contacts-closed temperature at which the thermally responsive element 15 returns to its normal state. When the ambient temperature is reduced to, for example, the value of 80° C., the thermally responsive element 15 in the state shown by the dotted line recovers the former normal state shown by full line, whereby the movable contacts are engaged with the fixed contacts. For the purpose of obtaining the hermetically sealed thermal switch, an opened end 18A of the housing 18 is hermetically secured to the base plate 11 by way of ring projection welding.

Although the depression mechanism by means of screw is employed for the calibration of the operative temperature of the thermally responsive element in the foregoing embodiments, various other methods may be employed. For example, a projection may be formed on the major surface of the support 4 (14) by pressing. The projection is bent so as to be engaged with the thermally responsive element. The operative temperature of the thermally responsive element may be varied by changing the angle at which the projection is bent, that is, by changing the contact pressure between the projection and the thermally responsive element.

Figure 8:
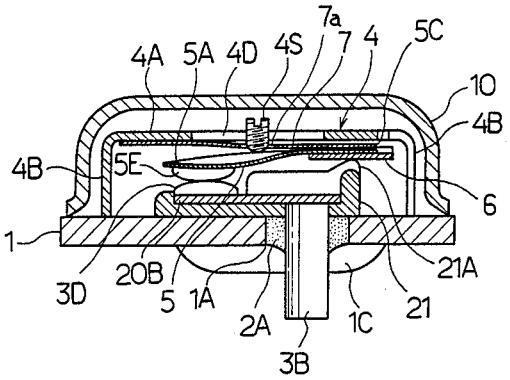
FIG. 8 is a longtudinal cross section of the threephase thermal protector in accordance with a third embodiment of the invention, along line VIII—VIII in FIG. 9.
Figure 9:
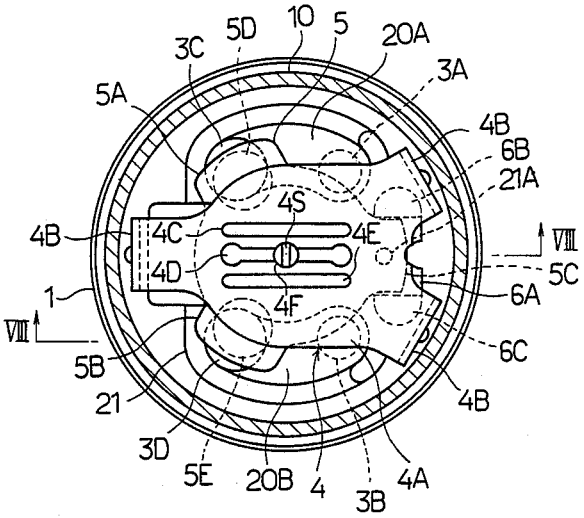
FIG. 9 is a plan view of the protector with the housing eliminated.

FIGS. 8 and 9 illustrate the thermal protector of a third embodiment. Identical parts are labelled by the same reference numerals as in FIGS. 1 and 2. The support 4 is identical as shown in FIG. 2 with exception that a portion 4A thereof has a generally Y-shaped configuration. The fixed contacts 3C, 3D are secured to the respective one ends of arc-shaped electrically conductive plates 20A, 20B serving as contact support arms. The conductive plates 20A, 20B are disposed on a ceramic plate 21 fixed on the upper side of the header plate 1. The other ends of the conductive plates 20A, 20B are secured to the terminal pins 3A, 3B by way of welding or the like, respectively. The thermally responsive element 5 is connected to the elastic member 7 through the connection strip 6 as in the foregoing embodiments. The elastic member 7 is canti-lever mounted on the support 4 so as to provide the same construction as shown in FIG. 1. The arrangement of the fixed contacts 3C, 3D differs from that shown in FIG. 1 as will be hereinafter described. Portions of the elastic member 7 and the thermally responsive element 5 connected to each other, or the connection strip 6 is positioned relatively close to the terminal pins 3A, 3B and away from the fixed contacts 3C, 3D. In this position, the connection strip 6 is engaged with the distal end of the projection-like pivot 21A formed integrally with the ceramic plate 21. The thermal protector shown in FIGS. 8 and 9 are characterized in that the terminal pins 3A, 3B are disposed laterally away from the fixed contacts 3C, 3D respectively and that the conductive plates 20A, 20B electrically insulated from the header plate 1 by the ceramic plate 21 are provided for connecting the fixed contacts 3C, 3D to the respective conductive plates 3A, 3B.

The foregoing disclosure and drawings are merely illustrative of the principles of the present invention and are not to be interpreted in a limiting sense. The only limitation is to be determined from the scope of the appended claims.

What is claimed is:

1. A three-phase thermal protector comprising:

(a) a metallic header plate having two apertures formed therein;

(b) two terminal pins secured in the apertures of said header plate by an insulating sealant material applied therebetween, respectively;

(c) a support plate secured to said header plate;

(d) two fixed contacts directly secured to one ends of said terminal pins so as to be opposite to said support plate on one and the same plane, respectively;

(e) an elastic member provided so as to be approximately parallel to said support plate, said elastic member having two ends, one of which ends being secured to said support plate;

(f) a thermally responsive element secured at one end thereof to the other end of said elastic member so as to be opposite to said elastic member, said thermally responsive member having an approximately central shallow dish-shaped portion so as to move and return with snap action in response to temperature change;

(g) two movable contacts secured to portions of said thermally responsive element, respectively, the portions of said thermally responsive element corresponding to two tops forming a triangle together with a top on said thermally responsive element on which top said elastic member is secured;

(h) a pivot mounted on a stationary member either at the header plate side or at the support plate side so that the surface of a connecting portions of said thermally responsive element and said elastic member is engaged therewith; and (i) an operative temperature calibrating mechanism provided on said pivot for exerting an approximately uniform contact pressure between said two movable contacts and said two fixed contacts and between the connecting portions of said thermally responsive element and said elastic member and said pivot, thereby pushing the dish-shaped portion of said thermally responsive element, said operative temperature calibrating mechanism including a means for controlling the pressure against the dish-shaped portion of said thermally responsive element.

2. A three-phase thermal protector as claimed in claim 1, which further comprises a contact support arm secured to said terminal pins and wherein said fixed contacts are secured to said contact support arm.

3. A three-phase thermal protector comprising:

(a) a metallic header plate having two apertures formed therein;

(b) two terminal pins secured in the apertures of said header plate by an insulating sealant material applied therebetween, respectively;

(c) a support plate secured to said header plate;

(d) two contact support arms mounted on said header plate with ceramics interposed therebetween, each said contact support arm having one end secured to said respective terminal pins and the other end to which two fixed contacts are secured, the fixed contacts being opposite to said support plate on one and the same plane;

(e) an elastic member provided so as to be approximately parallel to said support plate, said elastic member having two ends, one of which ends being secured to the side of said support plate corresponding to said fixed contacts;

(f) a thermally responsive element secured at one end thereof to the other end of said elastic member so as to be opposite to said elastic member, said thermally responsive element having an approximately central shallow dish-shaped portion so as to move and return with snap action in response to temperature change;

(g) two movable contacts secured to portions of said thermally responsive element, respectively, the portions of said thermally responsive element corresponding to two tops forming a triangle together with a top on said thermally responsive element on which top said elastic member is secured;

(h) a pivot formed integrally with the ceramics so that the surface of connecting portions of said thermally responsive element and said elastic member is engaged therewith; and (i) an operative temperature calibrating mechanism provided on said support plate for exerting an approximately uniform contact pressure between said two movable contacts and said two fixed contacts and between the connecting portions of said thermally responsive element and said pivot, thereby pushing the dish-shaped portion of said thermally responsive element, said operative temperature calibrating mechanism including a means for controlling the pressure against the dish-shaped portion of said thermally responsive element.

* * * * *

UNITED STATES PATENT AND TRADEMARK OFFICE

CERTIFICATE OF CORRECTION

PATENT NO. : 4,843,363

DATED : June 27, 1989

INVENTOR(S) : UBUKATA et al.

It is certified that error appears in the above-indentified patent and that said Letters Patent is hereby corrected as shown below:

Column 9, line 19, contains a clerical error wherein "pivot" should read --support plate--.

Signed and Sealed this

Ninth Day of May, 1995

Bruce Lehman

*Attest:*

BRUCE LEHMAN

*Attesting Officer*

*Commissioner of Patents and Trademarks*